US006709188B2

(12) United States Patent
Ushimaru

(10) Patent No.: US 6,709,188 B2
(45) Date of Patent: Mar. 23, 2004

(54) FITTING STRUCTURE FOR KNOBS

(75) Inventor: Hiroshi Ushimaru, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 49 days.

(21) Appl. No.: 10/114,161

(22) Filed: Apr. 2, 2002

(65) Prior Publication Data

US 2002/0144885 A1 Oct. 10, 2002

(30) Foreign Application Priority Data

Apr. 5, 2001 (JP) ..... 2001-107318
Apr. 5, 2001 (JP) ..... 2001-107319

(51) Int. Cl.[7] ..... G06G 1/10; H01H 3/08

(52) U.S. Cl. ..... 403/329; 403/14; 403/13; 403/17; 403/112; 16/441; 74/553; 74/558; 74/558.5

(58) Field of Search ..... 16/441; 74/553, 74/558, 558.5, 551.9; 403/13, 14, 17, 112, 329, DIG. 11, 331; 200/6 R, 336, 564; 338/184, 199

(56) References Cited

U.S. PATENT DOCUMENTS

| | | | | | |
|---|---|---|---|---|---|
| 2,501,008 | A | * | 3/1950 | Schramm | 74/548 |
| 3,172,071 | A | * | 3/1965 | Ihrig | 338/184 |
| 3,277,739 | A | * | 10/1966 | Morse | 74/558.5 |
| 3,324,267 | A | * | 6/1967 | Edelson | 200/336 |
| 4,084,675 | A | | 4/1978 | Smith et al. | 74/553 X |
| 4,135,471 | A | * | 1/1979 | Wooldridge et al. | 74/553 |
| 4,779,305 | A | * | 10/1988 | Gorsek | 74/553 |
| 4,802,409 | A | * | 2/1989 | Volk et al. | 101/111 |
| 4,920,823 | A | | 5/1990 | Mohr et al. | 74/553 |
| 5,018,951 | A | * | 5/1991 | Wang | 74/553 |
| 5,152,187 | A | * | 10/1992 | LaFemina | 74/553 |
| 5,236,006 | A | * | 8/1993 | Platusich et al. | 137/375 |
| 5,303,612 | A | * | 4/1994 | Odom et al. | 74/553 |
| 5,345,838 | A | * | 9/1994 | Howie, Jr. | 74/553 |
| 5,419,539 | A | * | 5/1995 | Bressler | 403/14 |
| 5,678,953 | A | * | 10/1997 | Usui et al. | 403/329 |
| 6,288,351 | B1 | * | 9/2001 | Bruntz | 200/336 |
| 6,508,144 | B1 | * | 1/2003 | Vendetti et al. | 74/553 |
| 6,610,947 | B2 | * | 8/2003 | Campana et al. | 200/336 |

FOREIGN PATENT DOCUMENTS

| | | | | |
|---|---|---|---|---|
| DE | 3120014 A1 | * | 12/1982 | G05G/1/08 |
| GB | 2130438 A | * | 5/1984 | G05G/1/10 |
| WO | 92-15796 | | 9/1992 | |

* cited by examiner

*Primary Examiner*—Anthony Knight
*Assistant Examiner*—Ernesto Garcia
(74) *Attorney, Agent, or Firm*—Brinks Hofer Gilson & Lione

(57) ABSTRACT

A fitting member is provided with a base having a flat portion, a stopper protruding forward from the base, and a through hole provided in a flat portion, wherein a knob has a plurality of projections positioned on the same circle. In fitting the knob to the fitting member, when the knob is rotated while being pressed backward in a state in which the projections are kept in contact with the flat portion, the projections slice on and in friction with a flat face, and when the projections hit against the stopper and the rotation of the knob is stopped, the projections and the through hole become opposite each other. After the projections are fitted into the through hole, the knob and the fitting member are enabled to be coupled to each other.

9 Claims, 5 Drawing Sheets

FITTING STRUCTURE FOR KNOBS

BACKGROUND OF THE INVENTION

1. Field of the Invention

The present invention relates to a fitting structure for knobs particularly suitable for fitting to shaft members of rotation drive members of motors and the like.

2. Description of the Prior Art

To describe a fitting structure for knobs according to the prior art with reference to a drawing, FIG. 6 shows an exploded perspective view of a fitting structure for knobs according to the prior art.

A rotation drive member 51 consisting of an electric motor has a substantially cylindrical body 51*a* and a columnar shaft member 51*b*, such as a rotation shaft or the like, protruding outward from the tip of the body 51*a*. This shaft member 51*b* is rotated as prescribed by supplying electric power to the body 51*a* from a terminal (not shown) and, when no power is supplied to the body 51*a*, the shaft member 51*b* has a prescribed revolving torque in either the clockwise or the counter-clockwise direction.

A fitting member 52 consisting of a synthetic resin member and formed by molding; a base 53; an annular first fitting portion 54 provided on the same circle as the base 53 sharing the center; and a second fitting portion 55 concentric with and having a greater diameter than the first fitting portion 54. The first fitting portion 54 and the second fitting portion 55 are formed in a collar shape, some protruding outward from the center axis of the base 53.

The base 53 has a front wall 53*a* formed to be a substantially flat face, and a cylindrical side wall 53*b* extending backward from the circumference of the front wall 53*a*. The annular first fitting portion 54 and the second fitting portion 55 are arranged protruding outward from the rear end of the cylindrical side wall 53*b*.

The front wall 53*a* of the base 53 has a round through holes 53*c* positioned at the center of the front wall 53*a*.

A cylindrical member 53*d* consisting of a metallic material and integrated by insert molding is arranged within the through holes 53*c*.

Into the cylindrical member 53*d* is inserted the shaft member 51*b* of the rotation drive member 51, and the cylindrical member 53*d* is fitted to the shaft member 51*b* with a suitable means such as a screw (not shown). This fitting integrates the fitting member 52 with the shaft member 51*b* to enable the fitting member 52 to rotate together with the shaft member 51*b*.

A knob 56 consisting of a synthetic resin material and formed by molding has a disk-shaped front wall 56*a*, a cylindrical side wall 56*b* extending backward from the circumference of the front wall 56*a*, a plurality (e.g. four) of hooks 57 protruding inward in the cylindrical side wall 56*b* and positioned on the same circle, and a plurality (e.g. four) of keep pieces 58 protruding inward within the cylindrical side wall 56*b* and positioned on the same circle. The hooks 57 and the keep pieces 58 are also positioned on the same circle.

In a state in which this knob 56 is arranged in front of and to concentrically cover the fitting member 52, each of the hooks 57 of the knob 56 is engaged with the annular first fitting portion 54, and each of the keep pieces 58 is kept in contact with and over the second fitting portion 55 to couple the knob 56 and the fitting member 52.

This coupling results in arrangement of the side wall 53*a* of the fitting member 52 within the side wall 56*b* of the knob 56.

Next will be described how the conventional knob fitting structure described above is assembled.

First, the cylindrical member 53*d* integrated with the fitting member 52 is fitted to the shaft member 51*b* of the rotation drive member 51.

Then, the front wall 56*a* of the knob 56 is arranged over and opposite the front wall 53*a* of the fitting member 52 to cover the front wall 53*a* so as to position the side wall 53*b* of the fitting member 52 within the side wall 56*b* of the knob 56.

When the knob 56 in this state is pressed in the direction of the axis of the shaft member 51*b*, the hooks 57 ride over the top of the first fitting portion 54 and are engaged with the first fitting portion 54, and the keep pieces 58 are arranged in contact with and over the second fitting portion 55.

The engaging of the hooks 57 with the first fitting portion 54 and the contact of the keep pieces 58 with the second fitting portion 55 cause the knob 56 to be fitted onto the fitting member 52.

However, the knob fitting structure described above involves the problem that, when the knob 56 is to fitted to the fitting member 52 by pressing in, if the knob 56 is pressed in a state of being inclined relative to the fitting member 52, the fitting member 52 is shaken to make the knob 56 difficult to be fitted and to make the hooks of the knob 56 to be engaged at the same time, adding to the difficulty of fitting.

Also the fitting of the knob 56 in a state of being only hooked onto the fitting member 52 invites the problem that the knob 56 slips relative to the fitting member 52.

SUMMARY OF THE INVENTION

An object of the present invention is to solve the problems noted above, and provide a fitting structure for knobs that facilitates fitting of the knob to its fitting member.

A fitting structure for knobs according to the invention is provided with a fitting member fitted to a shaft member and a knob arranged concentrically with the fitting member and fitted to a front face of the fitting member, wherein the fitting member has a base having a flat portion, a stopper protruding forward from the base, and a through hole provided in the flat portion, the knob has a plurality of projections positioned on the same circle, and in fitting the knob to the fitting member, when the knob is rotated while being pressed backward in a state in which the projections are kept in contact with the flat portion, the projections slide on and in contact with the flat portion and when the projections hit against the stopper and the rotation of the knob is stopped, the projections and the through hole become opposite each other to enable the knob and the fitting member to be coupled to each other after the projections are fitted into the through hole.

As this configuration enables the knob to be readily and reliably positioned relative to the fitting member, the fitting is simplified, resulting in a knob fitting structure in which, even if the knob is pressed in a state in which it is inclined relative to the fitting member, the projections enable the knob to be kept in a normal state by the flat portion and reliable coupling of the knob and the fitting member with no fear of slipping of the knob can be ensured.

In the fitting structure for knobs according to the invention, the base has a cylinder protruding forward in its central part, and the projections perform rotary actions with the cylinder as a guide.

This configuration, in which rotary actions are performed with the cylinder as a guide, can provide a knob fitting structure enabling the knob and the fitting member to be reliably coupled while the knob is maintained in an even more normal state.

In the fitting structure for knobs according to the invention, the through hole is formed adjacent to the stopper.

This configuration can provide a knob fitting structure ensuring reliable and easy positioning of the knob, simple and inexpensive assembling, and freedom from slips and excess play of the knob.

In the fitting structure for knobs according to the invention, a plurality of the stoppers and the through holes are provided.

This configuration can provide a knob fitting structure ensuring well balanced, stable and reliable fitting of the knob to the fitting member.

In the fitting structure for knobs according to the invention, the base of the fitting member has an annular fitting portion on the same circle, the knob has a plurality of hooks on the same circle, and the hooks of the knob are engaged with the fitting portion of the fitting member to couple the knob and the fitting member to each other.

This configuration can provide a knob fitting structure that facilitates fitting of the knob to the fitting member and ensures reliable fitting.

In the fitting structure for knobs according to the invention, the knob may have a plurality of keep pieces arranged on the same circle, each of the keep pieces may be positioned between the hooks of the knob, and each of the keep pieces is kept in contact with the fitting portion of the fitting member.

This configuration, as the knob is kept in contact with the fitting portion of the fitting member by the keep pieces, can provide a knob fitting structure in which the knob can be stably fitted to the fitting member.

In the fitting structure for knobs according to the invention, a position in which the fitting portion of the fitting member is engaged with the hooks of the knob is farther outward in a radial direction than a position in which the projections of the knob are fitted into the through hole of the fitting member.

This configuration, wherein the knob is engaged with the fitting member in a position having a greater diameter than the projections of the knob, can provide a knob fitting structure in which the knob can be stably engaged.

The fitting structure for knobs according to the invention is further provided with a rotation drive member of which the shaft member is rotatable, wherein the fitting member is fitted to the shaft member.

This configuration can provide a knob fitting structure enabling rotary action of the knob to achieve its normal coupling to the fitting member.

In the fitting structure for knobs according to the invention, the rotation drive member comprises a motor.

This configuration can provide a less costly knob fitting structure as its rotation drive member comprises a motor of a simple structure.

A fitting structure for knobs according to the invention is provided with a fitting member fitted to a shaft member and a knob arranged concentrically with the fitting member and fitted to a front face of the fitting member, wherein the fitting member has a base, a plurality of arcwise guides protruding forward from the base and provided on the same circle, gaps each provided between adjacent guides, and guide faces each provided at a top of one or another of the guides and inclined relative to the base, the knob has a plurality of projections positioned on the same circle, and in fitting the knob to the fitting member, when the knob is pressed backward in a state in which the projections are kept in contact with the guide faces, the projections are guided on the guide faces, the knob or the fitting member is rotated so as to enable the projections to approach the base and, after the projections are positioned in the gaps, the knob and the fitting member are enabled to be coupled to each other.

This configuration can provide a knob fitting structure which is easy to fit because the knob can be readily and reliably positioned relative to the fitting member and, even if the knob is pressed in a state in which it is inclined relative to the fitting member, the projections enable the knob to be kept in a normal state by the guides and reliable coupling of the knob and the fitting member can be ensured.

In the fitting structure for knobs according to the invention, the projections of the knob are held between adjacent ones of the guides of the fitting member.

This configuration can provide a knob fitting structure ensuring easy positioning of the knob relative to the fitting member, simple and inexpensive assembling, and freedom from slips of the knob.

In the fitting structure for knobs according to the invention, the fitting member is provided with through holes bored in the parts of the base positioned between the gaps, and the projections of the knob are fitted into the through holes.

This configuration can provide a knob fitting structure ensuring even more reliable and easy positioning of the knob, simple and inexpensive assembling, and freedom from slips and excess play of the knob.

In the fitting structure for knobs according to the invention, the projections of the knob are arranged to form a cross.

This configuration can provide a knob fitting structure in which the projections are arranged in a well balanced way, and therefore stable and reliable fitting of the knob to the fitting member is ensured.

In the fitting structure for knobs according to the invention, the guide faces, inclined in the same direction relative to the base, are formed at the tops of the plurality of guides of the fitting member.

This configuration, because the guide faces therein are inclined in the same direction, can provide a knob fitting structure that is simply and inexpensively configured.

In the fitting structure for knobs according to the invention, the base of the fitting member has an annular fitting portion on the same circle, the knob has a plurality of hooks on the same circle, and the hooks of the knob are engaged with the fitting portion of the fitting member to couple the knob and the fitting member to each other.

This configuration can provide a knob fitting structure enabling the knob to be easily and reliably fitted to the fitting member.

In the fitting structure for knobs according to the invention, the knob has a plurality of keep pieces arranged on the same circle, each of the keep pieces is positioned between the hooks of the knob, and each of the keep pieces is kept in contact with the fitting portion of the fitting member.

This configuration, as the knob is kept in contact with the fitting portion of the fitting member by the keep pieces, can provide a knob fitting structure in which the knob can be stably fitted to the fitting member.

In the fitting structure for knobs according to the invention, a position in which the fitting portion of the fitting member is engaged with the hooks of the knob is farther outward in a radial direction than a position in which the projections of the knob are arranged in the gaps.

This configuration, wherein the knob is engaged with the fitting member in a position having a greater diameter than the projections of the knob, can provide a knob fitting structure in which the knob can be stably engaged.

In the fitting structure for knobs according to the invention, the base of the fitting member may have a front wall and a cylindrical side wall extending backward from a circumference of the front wall, the front wall is provided with the guides protruding forward, the knob has a front wall and a cylindrical side wall extending backward from the circumference of the front wall, the front wall of the knob is fitted with the projections protruding backward in a state of being positioned in the cylindrical side wall, and the side wall of the fitting member is positioned within the side wall of the knob.

This configuration can provide a knob fitting structure permitting ready positioning of the knob relative to the fitting member and excelling in assembling ease.

The fitting structure for knobs according to the invention is further provided with a rotation drive member of which the shaft member is rotatable, wherein the fitting member is fitted to the shaft member, and the fitting member rotates together with the shaft member when the knob is fitted.

This configuration provides a knob fitting structure allowing the knob to readily fitted to the fitting member fitted to the rotating shaft member and permitting normal coupling of the knob to the fitting member by pressing the knob in.

DETAILED DESCRIPTION OF THE PREFERRED EMBODIMENTS

Figure 1:
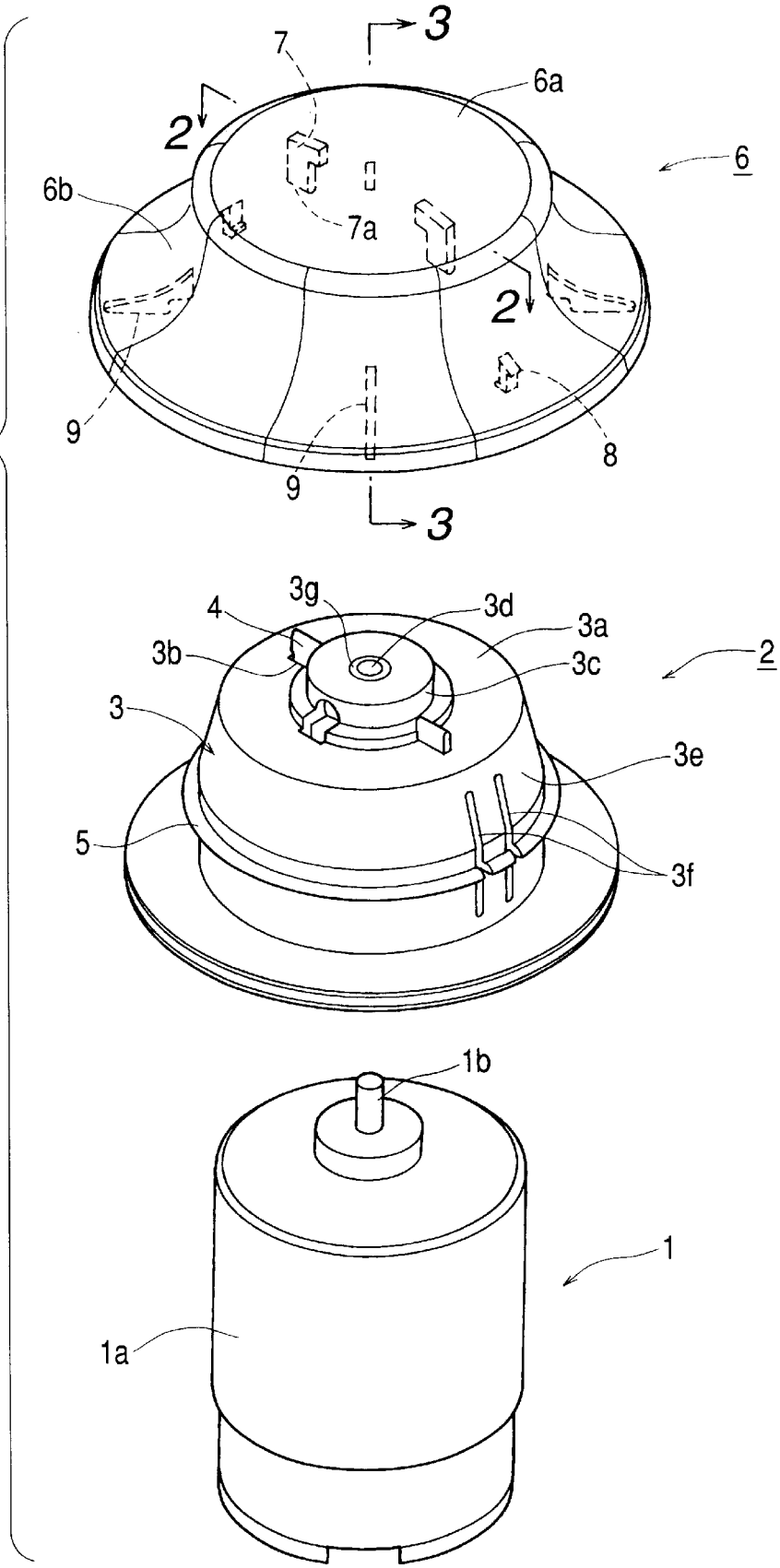
FIG. 1 shows an exploded perspective view of a fitting structure for knobs in a first mode of implementing the present invention.
Figure 2:
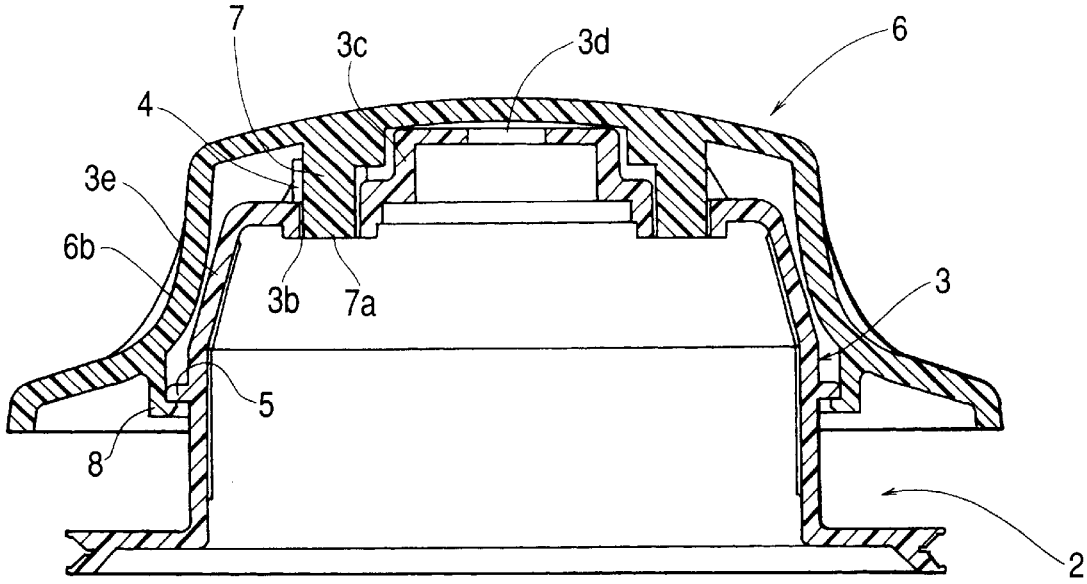
FIG. 2 shows a section of a knob and a fitting member pertaining to the knob fitting structure along line 2—2 in FIG. 1.
Figure 3:
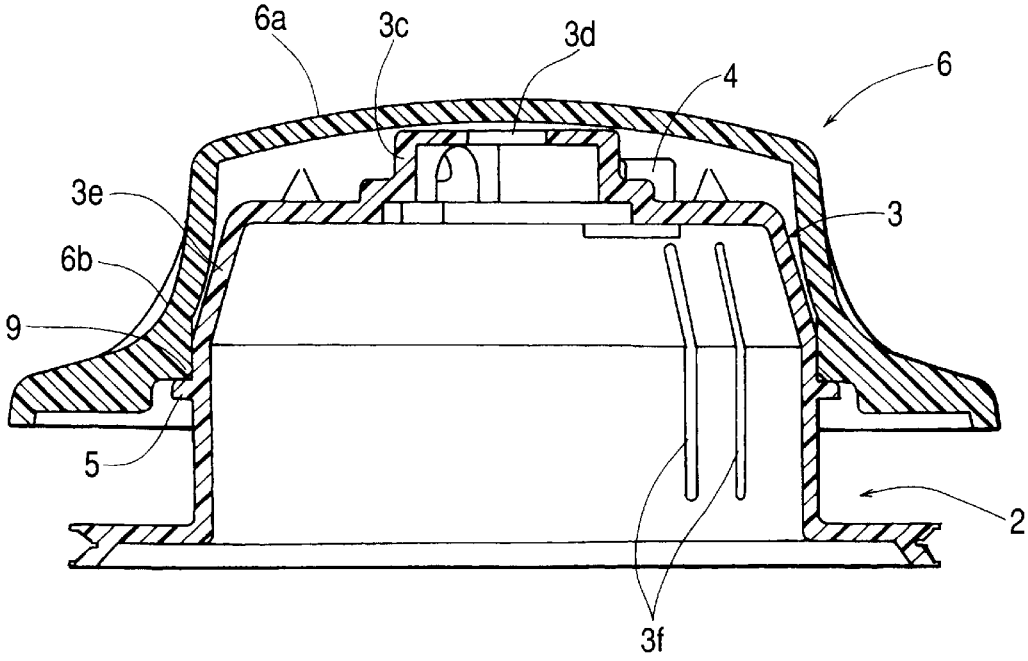
FIG. 3 shows a section of the knob and the fitting member pertaining to the knob fitting structure along line 3—3 in FIG. 1.

A fitting structure for knobs embodying the present invention in a first embodiment will be described below. FIG. 1 shows an exploded perspective view of a fitting structure for knobs in a first mode of implementing the invention; FIG. 2; a section of a knob and a fitting member pertaining to the knob fitting structure along line 2—2 in FIG. 1; and FIG. 3, a section of the knob and the fitting member pertaining to the knob fitting structure along line 3—3 in FIG. 1.

A rotation drive member 1 consisting of an electric motor has a substantially cylindrical body 1*a* and a shaft member 1*b* such as a columnar rotation shaft protruding outward from the tip of the body 1*a*. This shaft member 1*b* is rotated as prescribed by supplying electric power to the body 1*a* from a terminal (not shown) and, when no power is supplied to the body 1*a*, the shaft member 1*b* is configured to have a prescribed revolving torque in either the clockwise or the counter-clockwise direction.

A fitting member 2 consisting of a synthetic resin material and formed by molding has a base 3, a plurality of (e.g. two) stoppers 4 protruding forward from the base 3 and provided on the same circle as the base 3 sharing the center, and an annual fitting portion 5 provided on the same circle as the base 3 sharing the center.

The base 3 has a round flat portion 3*a*, a plurality of (e.g. two) first rectangular through holes 3*b* provided on a straight line passing the center of the flat portion 3*a*, a cylinder 3*c* protruding forward in the central part of the flat portion 3*a* of the base 3, a round second through holes 3*d* provided in the central part of the cylinder 3*c*, and a cylindrical side wall 3*e* extending backward from the circumference the flat portion 3*a* with its diameter expanding as it extends. The stoppers 4 and the first through holes 3*b* are formed on or in the flat portion 3*a*, and the first through holes 3*b* are formed adjoining the stoppers 4.

The fitting portion 5 is formed in a collar shape protruding outward from the side wall 3*e* of the base 3, and two grooves 3*f* are formed, spanning these fitting portion 5 and side wall 3*e*, in a direction parallel to the axis of the base 3 and in opposite positions in the base 3.

A cylindrical member 3*g* consisting of a metallic material and integrated by insert molding is arranged within the second through holes 3*d*.

Into the cylindrical member 3*g* is inserted the shaft member 1*b* of the rotation drive member 1, and the cylindrical member 3*g* is fitted to the shaft member 1*b* with a suitable means such as a screw (not shown). This fitting integrates the fitting member 2 with the shaft member 1*b* to enable the fitting member 2 to rotate together with the shaft member 1*b*.

A knob 6 consisting of a synthetic resin material and formed by molding has a round front wall 6*a*; a cylindrical side wall 6*b* extending backward from the circumference of the front wall 6*a* with its diameter expanding as it extends; a plurality (e.g. two) of projections 7 protruding backward (inward) in a state in which they are positioned within the side wall 6*b* of the front wall 6*a* and on the same circle; a plurality (e.g. two) of hooks 8 protruding inward within the cylindrical side wall 6*b* and positioned on the same circle; and a plurality (e.g. four) of keep pieces 9 protruding inward within the cylindrical side wall 6*b* and positioned on the same circle. The hooks 8 and the keep pieces 9 are positioned on the same circle, and the keep pieces 9 are arranged between the hooks 8.

Further, a plurality (e.g. two) of projections 7 are arranged on a straight line passing the center axis, namely at equal intervals of 180 degrees each, and each of these projections 7 has an L overall shape, whose top 7*a* is formed in an arc shape.

The plurality (e.g. two) of hooks 8 are positioned farther outward in the radial direction than the projections 7 are and on the same straight line as the positions in which the projections 7 are arranged.

The plurality (e.g. four) of keep pieces 9 are positioned farther outward in the radial direction than the projections 7 are and between the hooks 8 to form a cross.

In a state in which this knob 6 is arranged in front of and to concentrically cover the fitting member 2, the tops 7*a* of the projections 7 are fitted into the first through holes 3*b*, and the hooks 8 of the knob 6 are engaged with the fitting portion 5 of the fitting member 2, while the keep pieces 9 are kept in contact with and over the fitting portion 5 to fit the knob 6 and the fitting member 2 coupled to each other.

This coupling results in positioning of the base 3 of the fitting member 2 within the side wall 6*b* of the knob 6.

Next will be described how the above-described knob fitting structure in the first embodiment of the invention is assembled.

First, the cylindrical member 3*g* integrated with the fitting member 2 is fitted to the shaft member 1*b* of the rotation drive member 1.

Then, when the knob 6 is turned with the tops 7*a* of the projections 7 projecting backward (inward) from the front wall 6*a* of the knob 6 kept in contact with the flat portion 3*a* of the base 3 of the fitting member 2, the projections 7 turn, guided by the outer circumference of the cylinder 3*c*. This regulates the position of the knob 6 in a normal state relative to the fitting member 2.

Thus, as the knob 6 is turned clockwise, for instance, while being pressed in the axial direction of the shaft member 1*b* (backward), the projections 7 slide over the flat face 3*a* in frictional contact with it, and hit against the stoppers 4 to stop the rotation of the knob 6.

Then, when this knob 6 is stopped, the projections 7 and the first through holes 3*b* are opposite each other, the knob 6 shifts in the axial direction (backward), and the projections 7 are fitted into the first through holes 3*b*.

At the same time as this fitting of the projections 7 into the first through holes 3*b*, the hooks 8 are engaged with the fitting portion 5 of the fitting member 2, and the keep pieces 9 are kept in contact with the fitting portion 5.

The engaging of the fitting portion 5 with the hooks 8 and the fitting of the tops 7*a* of the projections 7 into the first through holes 3*b* cause the knob 6 and the fitting member 2 to be coupled to each other.

Incidentally, although the projections of the knob are arranged on the same straight line in the first preferred embodiment of the invention described above, the appropriate arrangement is not limited to this, but it is adequate for one, three or more projections to be arranged in a prescribed position or positions, and one or more through holes formed opposite the projection or projections in the fitting member.

Further, while the rotation drive member having a shaft member consists of a motor in the first embodiment described above, the appropriate configuration is not limited to this, but the rotation drive member may consist of a rotary electrical part or mechanical part, such as an encoder.

Figure 4:
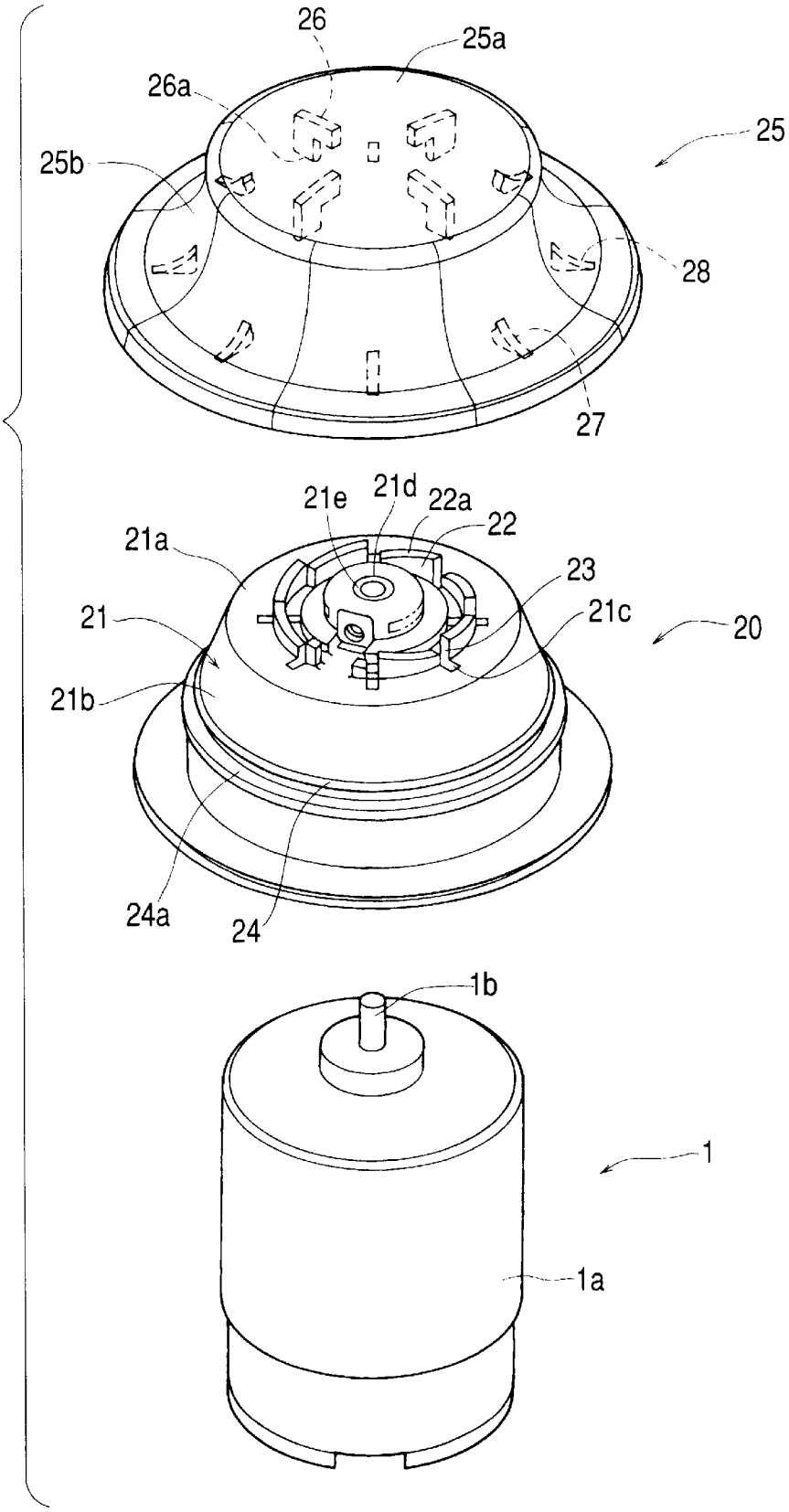
FIG. 4 shows an exploded perspective view of a fitting structure for knobs in a second mode of implementing the invention.
Figure 5:
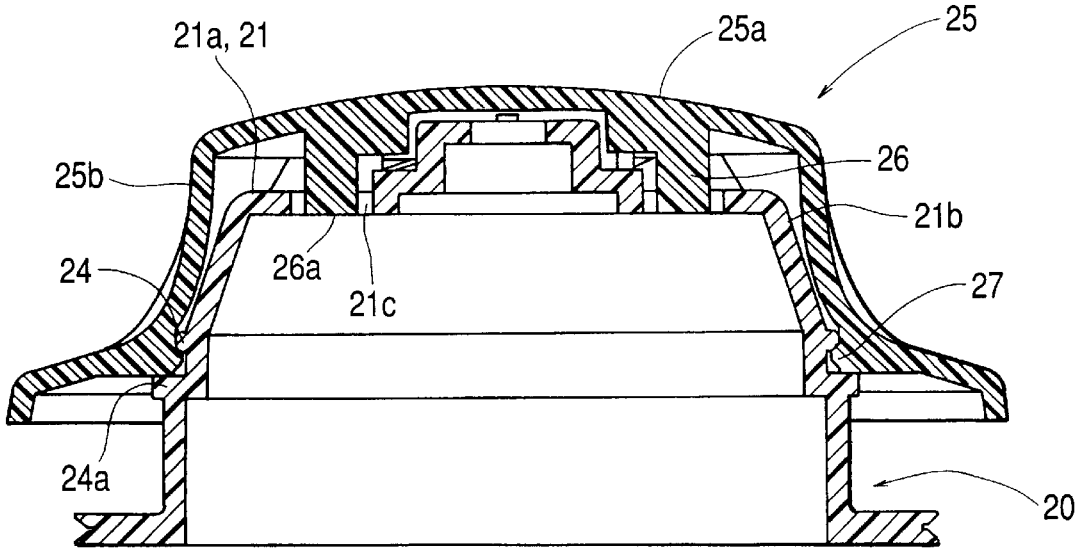
FIG. 5 shows a section of a knob and a fitting member pertaining to the knob fitting structure in the second mode of implementing the invention.
Figure 6:
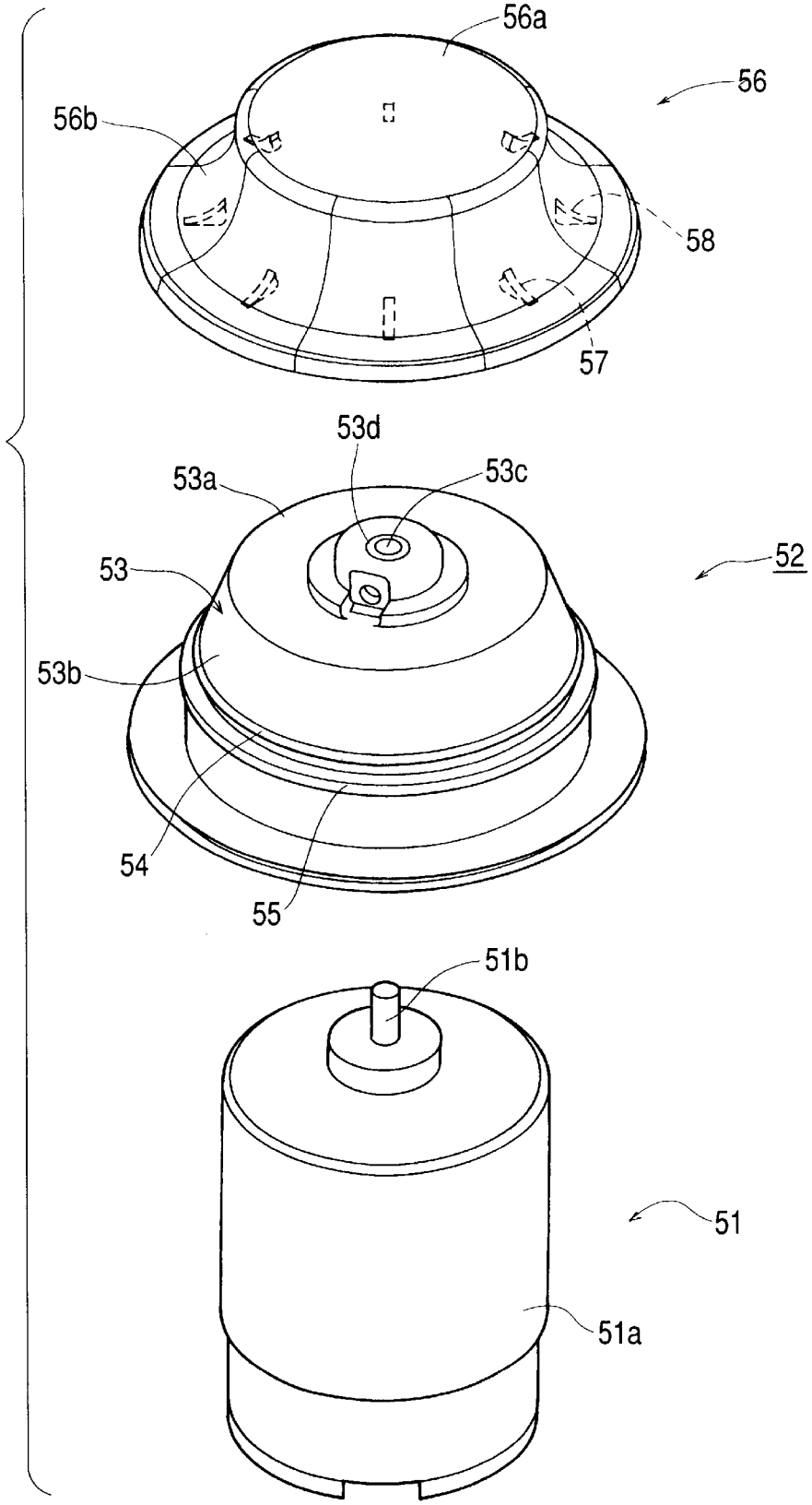
FIG. 6 PRIOR ART
FIG. 6 shows an exploded perspective view of a fitting structure for knobs according to the prior art.

Next, a fitting structure for knobs embodying the present invention in a second embodiment will be described below. FIG. 4 shows an exploded perspective view of a fitting structure for knobs in a second mode of implementing the invention, and FIG. 5, a section of a knob and a fitting member pertaining to the knob fitting structure shown in FIG. 4. The same constituent parts as in the first mode of implementing the invention are assigned respectively the same reference signs, and their description is dispensed with.

A fitting member 20 consisting of a synthetic resin material and formed by molding has a base 21; a plurality (e.g. eight) of arcwise guides 22 provided on the same circle as the base 21 sharing the center; a plurality (e.g. eight) of gaps 23 each provided adjoining guides 22; guide faces 22*a* each provided at the top of a guide 22; an annular first fitting portion 24 provided on the same circle as the base 21 sharing the center; and a second fitting portion 24*a* on the same circle as the first fitting portion 24 and having a greater diameter than the first fitting portion 24. The first fitting portion 24 and the second fitting portion 24*a* are formed in a collar shape protruding outward from the central axis of the base 21.

The base 21 has a front wall 21*a* formed to be a substantially flat face, and a cylindrical side wall 21*b* extending backward from the circumference of the front wall 21*a*, and to the front wall 21*a* are fitted the plurality of arcwise guides 22 protruding forward. The annular first fitting portion 24 and the second fitting portion 24*a* are arranged protruding outward from the rear end of the cylindrical side wall 21*b*.

The guide faces 22*a* of the guides 22 are inclined in the same direction relative to the front wall 21*a* of the base 21.

The front wall 21*a* of the base 21 has a plurality (e.g. eight) of rectangular first through holes 21*c* positioned between the gaps 23 and a round second through 21*d* position at the center of the front wall 21*a*.

Further, a cylindrical member 21*e* consisting of a metallic material and integrated by insert molding is arranged within the second through holes 21*d*.

Into the cylindrical member 21*e* is inserted the shaft member 1*b* of the rotation drive member 1, which is fitted to the cylindrical member 21*e* or the shaft member 1*b* with a suitable means such as a screw (not shown). This fitting integrates the fitting member 20 with the shaft member 1*b* to enable the fitting member 20 to rotate together with the shaft member 1*b*.

A knob 25 consisting of a synthetic resin material and formed by molding has a round front wall 25*a*; a cylindrical side wall 25*b* extending backward from the circumference of the front wall 25*a* with its diameter expanding as it extends; a plurality (e.g. four) of projections 26 protruding backward (inward) in a state in which they are positioned within the side wall 25*b* of the front wall 25*a* and on the same circle; a plurality (e.g. four) of hooks 27 protruding inward within the cylindrical side wall 25*b* and positioned on the same circle; and a plurality (e.g. four) of keep pieces 28 protruding inward within the cylindrical side wall 25*b* and positioned on the same circle. The hooks 27 and the keep pieces 28 are positioned on the same circle, and the keep pieces 28 are arranged between the hooks 27.

Further, a plurality (e.g. four) of projections 26 are arranged to form a cross, namely at equal intervals of 90 degrees each, and each of these projections 26 has an L overall shape, whose top 26*a* is formed in an arc shape.

The plurality (e.g. four) of hooks 27 are positioned farther outward in the radial direction than the projections 26 are and on the same straight line as the positions in which the projections 26 are arranged to form a cross.

The plurality (e.g. four) of keep pieces 28 are positioned farther outward in the radial direction than the projections 26 are and between the hooks 27 to form a cross.

In a state in which this knob 25 is arranged in front of and to concentrically cover the fitting member 20, the projections 26 of the knob 25 are positioned in the gaps 23 of the fitting member 20, and the tops 26*a* of the projections 26 are fitted into the first through holes 21*c*.

The hooks 27 of the knob 25 are engaged with the annular first fitting portion 24, and the keep pieces 28 are kept in contact with and over the second fitting portion 24*a* to couple the knob 25 and the fitting member 20 to each other.

This coupling results in positioning of the side wall 21*b* of the fitting member 20 within the side wall 25*b* of the knob 25.

Next will be described how the above-described knob fitting structure in the second mode of implementing the invention is assembled.

First, the cylindrical member 21*e* integrated with the fitting member 20 is fitted to the shaft member 1*b* of the rotation drive member 1.

Then, the tops 26*a* of the projections 26 projecting backward (inward) from the front wall 25*a* of the knob 25 are brought into contact with the guide faces 22*a* of the guides 22 of the fitting member 20. This regulates the position of the knob 25 in a normal state relative to the fitting member 20.

Then, as the knob 25 is pressed in the axial direction of the shaft member 1*b*, the tops 26*a* of the projections 26 are pressed against the inclined guide faces 22*a*, resulting in, for instance, clockwise turning of the fitting member 20 and shifting of the tops 26*a* to the positions of the gaps 23 of the fitting member 20. That is, the shaft member 1*b* is rotated by pressing the knob 25 in the axial direction.

The rotations of the shaft member 1*b* and the fitting member 20 cause the knob 25 to shift in the axial direction, the projections 26 to be positioned so as to be caught in the gaps 23, and the tops 26*a* to be fitted into the first through holes 21*c* between the gaps 23.

At the same time as this fitting of the projections 26 into the first through holes 21*c*, the hooks 27 of the knob 25 are engaged with the fitting portion 24 of the first fitting member 20, and the keep pieces 28 are kept in contact with the second fitting portion 24*a*.

The engaging of the first fitting portion 24 with the hooks 27 and the fitting of the tops 26*a* of the projections 26 into the first through holes 21*c* cause the knob 25 and the fitting member 20 to be coupled to each other.

Incidentally, although through holes are provided in the parts of the base positioned between the gaps in the second preferred embodiment of the invention described above, the through holes can be dispensed with.

Further, although the projections of the knob are arranged to form a cross in the above-described second embodiment of the invention, the appropriate arrangement is not limited to this, but it is adequate for one, two or more projections to be arranged in a prescribed position or positions.

Also, although the guide faces of the guides are inclined in one direction relative to the base in the above-described second embodiment, the appropriate arrangement is not limited to this, but it is adequate to incline the guide faces alternately in different directions.

Further, although the rotation drive member having a shaft member is a motor in the above-described second embodiment, the appropriate rotation drive member is not limited to this, but may as well be a rotary mechanical part or electrical part.

As hitherto described, in the fitting structure for knobs according to the invention, a fitting member has a base having a flat portion, stoppers protruding forward from the base, and through holes provided in the flat portion; the knob has a plurality of projections positioned on the same circle; and in fitting the knob to the fitting member, when the knob is rotated while being pressed backward in a state in which the projections are kept in contact with the flat portion, the projections slide on and in contact with the flat portion, and when the projections hit against the stoppers and the rotation of the knob is stopped, the projections and the through holes become opposite each other to enable the knob and the fitting member to be coupled to each other after the projections are fitted into the through hole. As this arrangement enables the knob to be readily and reliably positioned relative to the fitting member, the fitting is simplified, resulting in a knob fitting structure in which, even if the knob is pressed in a state in which it is inclined relative to the fitting member, the projections enable the knob to be kept in a normal state by the flat portion and reliable coupling of the knob and the fitting member can be ensured.

In the fitting structure for knobs according to the invention, the base may have a cylinder protruding forward in its central part, and the projections perform rotary actions with the cylinder as guide. This configuration, in which rotary actions are performed with the cylinder as a guide, can provide a knob fitting structure enabling the knob and the fitting member to be reliably coupled while the knob is maintained in an even more normal state.

In the fitting structure for knobs according to the invention, the base of the fitting member may have an annular fitting portion on the same circle, the knob has a plurality of hooks on the same circle, and the hooks of the knob are engaged with the fitting portion of the fitting member to couple the knob and the fitting member to each other. This configuration can provide a knob fitting structure that facilitates fitting of the knob to the fitting member and ensures reliable fitting.

In the fitting structure for knobs according to the invention, the position in which the fitting portion of the fitting member is engaged with the hooks of the knob may be farther outward in the radial direction than the position in which the projections of the knob are fitted into the through hole of the fitting member. This configuration, wherein the knob is engaged with the fitting member in a position having a greater diameter than the projections, can provide a knob fitting structure in which the knob can be stably engaged.

As described above, in the fitting structure for knobs according to the invention, the fitting member has a base, a plurality of guides protruding forward from the base, gaps each provided between adjacent guides, and guide faces each provided at the top of one or another of the guides and inclined relative to the base, wherein the knob has a plurality of projections positioned, and in fitting the knob to the fitting member, when the knob is pressed backward in a state in which the projections are kept in contact with the guide faces, the projections are guided on the guide faces, the knob or the fitting member is rotated so as to enable the projections to approach the base and, after the projections are positioned in the gaps, the knob and the fitting member are enabled to be coupled to each other. This configuration can provide a knob fitting structure which is easy to fit because the knob can be readily and reliably positioned relative to the fitting member.

In the fitting structure for knobs according to the invention, the fitting member may be provided with through holes bored in the parts of the base positioned between the gaps, and the projections of the knob are fitted into the through holes. This configuration can provide a knob fitting structure ensuring even more reliable and easy positioning of the knob, simple and inexpensive assembling, and freedom from slips and excess play of the knob.

In the fitting structure for knobs according to the invention, the guide faces, inclined in the same direction relative to the base, may be formed at the tops of the plurality of guides of the fitting member. This configuration, because the guide faces therein are inclined in the same direction, can provide a knob fitting structure that is simply and inexpensively configured.

What is claimed is:

1. A fitting structure for knobs comprising:

a fitting member fitted to a shaft member and a knob arranged concentrically with the fitting member and fitted to a front face of the fitting member, wherein the fitting member has a base having a flat portion, a stopper protruding forward from the base, and a through hole provided in the flat portion, wherein the knob has a plurality of projections positioned on a first circle, and wherein in fitting the knob to the fitting member, when the knob is rotated while being pressed backward in a state in which the projections are kept in contact with the flat portion, the projections slide on and in contact with the flat portion and when the projections hit against the stopper and the rotation of the knob is stopped, the projections and the through hole become opposite each other to enable the knob and the fitting member to be coupled to each other after the projections are fitted into the through hole.

2. The fitting structure for knobs according to in claim 1, wherein a cylinder protrudes forward in a central part of the base, and wherein the projections perform rotary actions with the cylinder as a guide.

3. The fitting structure for knobs according to in claim 1, wherein the through hole is formed adjacent to the stopper.

4. The fitting structure for knobs according to in claim 1, wherein a plurality of the stoppers and the through holes are provided.

5. The fitting structure for knobs according to in claim 1, wherein the base of the fitting member has an annular fitting portion on a second circle, wherein the knob has a plurality of hooks corresponding to the second circle, and wherein the hooks of the knob are engaged with the fitting portion of the fitting member to couple the knob and the fitting member to each other.

6. The fitting structure for knobs according to in claim 5, wherein the knob has a plurality of keep pieces arranged corresponding to the second circle, wherein each of the keep pieces is positioned between the hooks of the knob, and wherein each of the keep pieces is kept in contact with the fitting portion of the fitting member.

7. The fitting structure for knobs according to in claim 5, wherein a position in which the fitting portion of the fitting member is engaged with the hooks of the knob is farther outward in a radial direction than a position in which the projections of the knob are fitted into the through hole of the fitting member.

8. The fitting structure for knobs according to in claim 1, further provided with a rotation drive member of which the shaft member is rotatable, wherein the fitting member is fitted to the shaft member.

9. The fitting structure for knobs according to in claim 8, wherein the rotation drive member comprises a motor.

* * * * *